United States Patent [19]

Schwab

[11] Patent Number: 4,527,784

[45] Date of Patent: Jul. 9, 1985

[54] ASSEMBLY APPARATUS FOR MAKING FRAMES OR PANELS

[75] Inventor: Bernard Schwab, Essert, Switzerland

[73] Assignee: Andre' Gueissaz et Cie, S.A., Vaud, Switzerland

[21] Appl. No.: 438,895

[22] PCT Filed: Mar. 4, 1982

[86] PCT No.: PCT/CH82/00033

§ 371 Date: Oct. 28, 1982

§ 102(e) Date: Oct. 28, 1982

[87] PCT Pub. No.: WO82/03041

PCT Pub. Date: Sep. 16, 1982

[30] Foreign Application Priority Data

Mar. 5, 1981 [CH] Switzerland ..... 1491/81

[51] Int. Cl.[3] ..... B25B 1/20

[52] U.S. Cl. ..... 269/42; 269/109; 269/130

[58] Field of Search ..... 269/41, 111, 112, 121, 269/130, 131, 132, 152, 155, 156, 42, 109

[56] References Cited

U.S. PATENT DOCUMENTS

| | | | |
|---|---|---|---|
| 891,121 | 6/1908 | Wichers | 269/131 |
| 1,770,763 | 7/1930 | Wolfstyn | 269/131 |
| 2,448,331 | 8/1948 | Staab et al. | 269/121 |
| 4,163,547 | 8/1979 | Jerome | 269/42 |

*Primary Examiner*—Frederick R. Schmidt
*Assistant Examiner*—Judy J. Hartman
*Attorney, Agent, or Firm*—Parkhurst & Oliff

[57] ABSTRACT

The elements of the frame, such as A, B, C, and D are held in place by the four angles (1) disposed at the corners of the frame and by the cramps (5, 6, 7, 8) mounted on each angle. On the other hand, each angle comprises a semi-circular flat sheave (1*e*) surrounding its right-angle apex. The edge of this sheave is provided with a groove (4) in which the cable (3) passes. The tightener (2) comprises a clamp (13) tightened by a screw (16) permitting the two strands of the cable (3) to be clamped between its body and its gripping part. The nut (23) bearing against the end side of the frame (10) acts upon the threaded rod (22) and exerts a pull on the clamp (13) through which the cable is tightened and the elements of the frame are squeezed tight against one another.

7 Claims, 4 Drawing Figures

A
B
C
D
1
1a
1b
1c
1e
2
3
9
10
10a
10b
10c
11
12
13
14
14a
15
16
17
18
19
20
21
22
23
24
25
III

ASSEMBLY APPARATUS FOR MAKING FRAMES OR PANELS

Until now, the artisan or the amateur wishing to realize a wooden frame by means of four rectilinear elements bevel-cut and glued, so as to receive a mirror, or a painting, or to constitute a window or a door frame, or even some sort of panel, had to provide himself with numerous joiner's cramps, by means of which he fixed the frame alter coating the joining surfaces with the glue, on the plate of a table or of a bench. This operation required the use of numerous clamping instruments, was delicate to carry out, and often led to bad workmanship.

The purpose of the present invention is to facilitate the making of frames of rectilinear elements bevel-cut and glued, thanks to an apparatus which is not very bulky, easy to put in place, and reliable.

To this end, it proposes, according to the main claim appended hereto, an assembly apparatus for making frames or panels, characterized in that it comprises a set of angles, each capable of embracing a corner of the frame or of the panel and provided with guide means, a cable surrounding the angles, passing in the said guide means, and a tightener to which two end segments of the cable are attached and which is capable of being operated so as to tighten the central segment of the cable around the angles.

An embodiment of the apparatus according to the invention will be described below, by way of example referring to the appended drawing, of which:

Figures 1, 3:
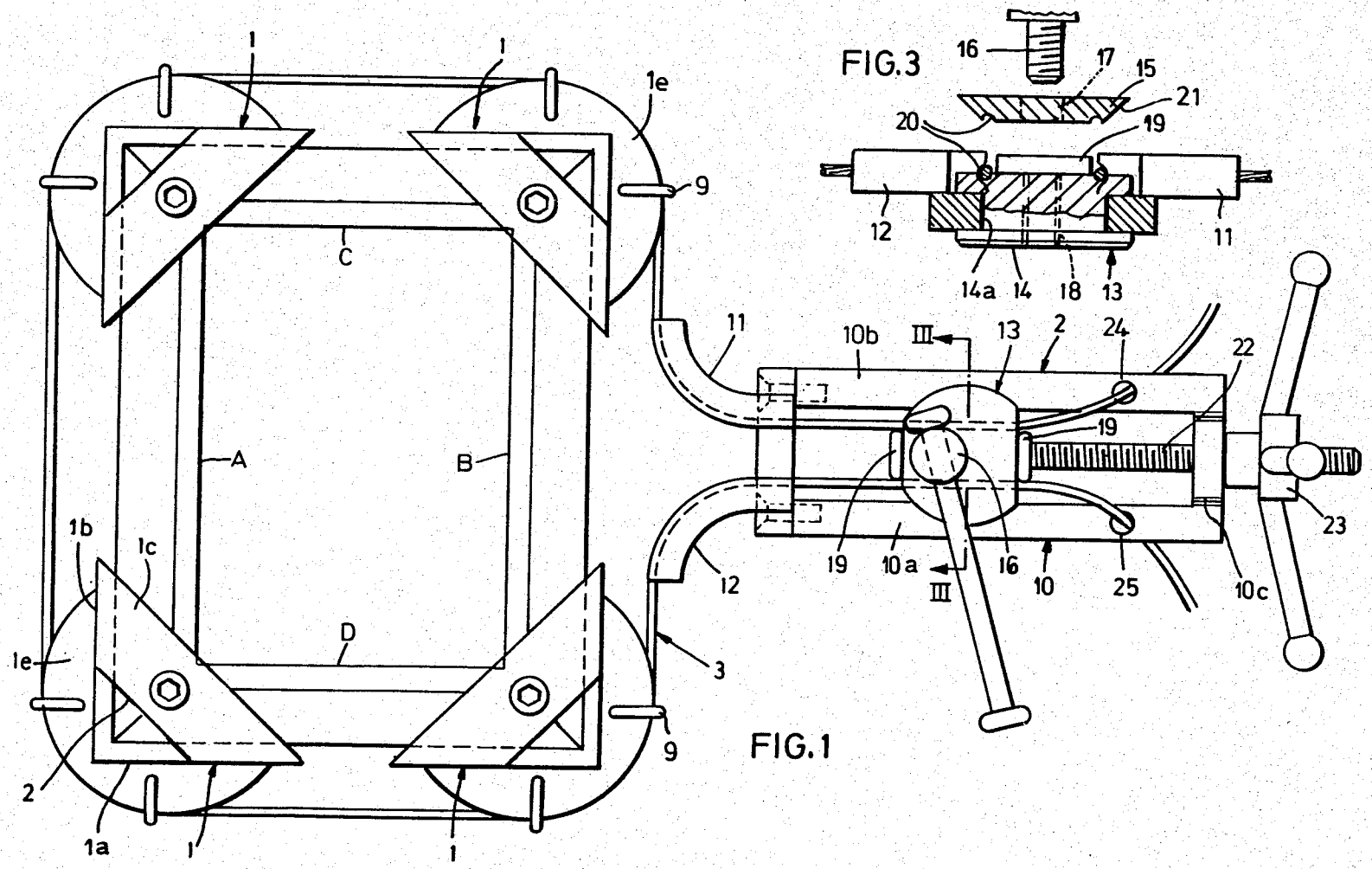
FIG. 1 is a top plan view.
FIG. 3 is a sectional view of the tightener along the line III—III of FIG. 1, and FIG. 4 a sectional view analogous to that of FIG. 3, representing a variant of execution of the clamp incorporated in the tightener.
Figure 2:
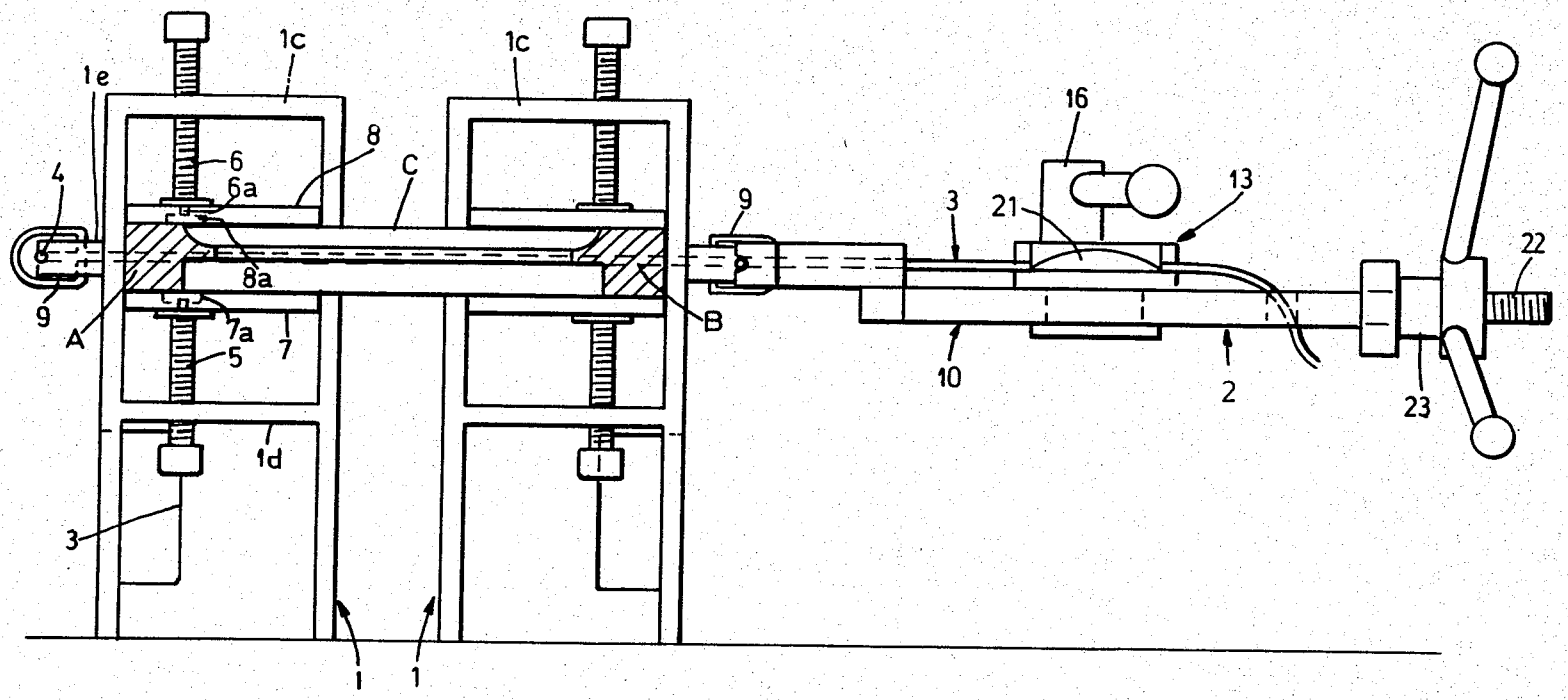
FIG. 2 is a partial elevation of this embodiment.

The apparatus depicted in the drawing can be used for making frames of very variable dimensions, the minimum dimension being on the order of 10×10 cm. and the largest dimension being able to attain up to 1×2 m. or even more, according to the length of the cable used.

The apparatus comprises, on the one hand, four angles designated by 1, on the other hand, a tightener designated by 2, and finally a flexible metal cable 3. The angles will preferably be of a light alloy and obtained by molding. They are formed of a rectilinear body of a length of about 15 cm., composed of two walls 1*a* and 1*b* oriented at right angles to one another. The angles further comprise an upper wall 1*c* and, at mid-height, a middle wall 1*d* parallel to the upper wall 1*c*. As is seen in FIG. 1, the upper walls 1*c* do not cover the whole surface of the angle but leave the inside corner uncovered by contriving an opening 32 of triangular shape which permits veriyfying the positioning of the fillets which form the sides of the frame when these have been put in place, as will be seen further on. Each angle comprises a second opening 33 which is contrived between the middle wall 1*d* and the foot of the angle and which likewise extends into the corner of the angle, i.e., partly in the wall 1*a* and partly in the wall 1*b*. At mid-height between the walls 1*d* and 1*c*, each angle further comprises a flat sheave 1*e* extending toward the outside, the plan shape of which is that of a semi-circle, and the edge of which is provided with a groove 4. All these elements are cast in one piece, and during mass production, a permanent mold may be provided for, permitting these parts to be taken out without their needing any retouching but for the tapping of two coaxial openings contrived at the center of the wall 1*c* and at the center to the wall 1*d*. These tappings are each intended to receive one of the two screws 5 and 6 which bear the plates 7 and 8 of the cramp associated with each angle. Each plate 7 and 8 is connected to the end of the screw which bears it by a tenon 6*a* or 5*a* which prolongs the screw and by a clamping washer fixed to the tenon and fitted in a recess 7*a* or 8*a* of the plate. It is understood that the plates 7 and 8 are guided by the walls 1*a* and 1*b*, while for ensuring the stability of the screws 5 and 6, the walls 1*c* and 1*d* may be provided with bosses intended to crease the length of the tappings which pass through them. In their right-angled apex, the plates are likewise cut on the skew to make the joints of the frames visible during assembly.

To complete the description of the angles, it is also proper to mention that the flat sheaves 1*e* acting as slideways are each equipped with two stirrup-pieces 9 which hold the cable 3 in place at the time of mounting the apparatus on a frame assembly.

The four angles 1 may be provided with a base plate (not shown). They are intended to be mounted on some sort of horizontal support, table or bench, while the cable 3 is fitted in the grooves 4 and he fillets A, B, C, and D of a frame are placed between the plates 7 and 8 of the cramps. The latter permit elements of frames of different thicknesses to be assembled owing to the fact that the two plates 7 and 8 are movable in the longitudinal direction of the angles. Whatever may be the thickness of the frame, it is thus possible to place the elements A, B, C, D in such a way that their center of gravity is at the height of the flat sheave 1*e*. Thus, at the time of tightening of the cable, no moment of torsion is registered. This arrangement is essential for ensuring the positioning of the frame elements so as to avoid any warping. As the cramps permit joining each pair of elements in a predetermined position, it is seen that the apparatus described permits avoiding the warping of the frame even if the inner surfaces of the bevels, intended to contain the film of glue between them, are not absolutely even.

For ensuring the gripping of the frame, the tightener 2 is used. The latter will preferably be composed of high-strength metal parts, iron, steel, or, if need be, nickel silver or brass. It is made up of an elongated rectangular frame 10 provided at one of its ends with two arcuate slideways 11 and 12 disposed symmetrically. Preferably, the two slideways 11 and 12 and the crossbar of the frame 10 which is adjacent to these two slideways will be made in one molded piece, whereas the rest of the U-shaped frame will constitute a second piece, the two pieces being fixed to one another, for example by screws. The two longitudinal sides 10*a* and 10*b* of the frame 10 are of rectangular cross-section and serve as guide rails for a clamp 13 made up so as to slide along the frame. This clamp 13 is itself composed of three parts: a clamp body 14 of approximately circular shape with a rectangular groove 14*a* in its circumference, a gripping part 15, likewise in the shape of a flat disk which is held on the clamp body 14, and a fixing screw 16. This screw passes through an off-center hole 17 in the part 15 and fits into a tapping 18 on the clamp body 14. At the front and at the rear, the clamp body 14 exhibits two edges 19 which ensure the centering of the part 15 relative to the clamp body 14. The body 14 and the gripping part 15 are each provided with two parallel grooves 20 oriented along the axis of the tightener and in which the end segments of the cable 3 come to be fitted at the time of tightening. To facilitate the fitting of the cable segments, the gripping part 15 also exhibits two bevels 21 on its two sides facing the longitudinal elements 10*a* and 10*b* of the frame 10.

The clamp body 14 is fixed at the end of a threaded rod 22 which extends longitudinally between the elements 10*a* and 10*b*, which passes through a smooth hole contrived in the transverse portion 10*c* of the frame 10, and on which a wing-nut 23 is fitted. It is understood that when the two end elements of the cable 3 have been fixed to the clamp 13 after fitting into the grooves 20 and tightening of the screw 16, the wing-nut 23 bearing against the crossbar 10*c* permits a pull to be exerted on the clamp 13 through the threaded rod 22. The cable rests in the bottom of the grooves 4 and in the slide grooves 11 and 12, so that it is led without undergoing any bending stress right into the clamp 13, in which it is likewise fixed without deformation or damage. To facilitate the operations, the two ends of the cable 3 may be fitted in the holes 24 and 25 contrived in the longitudinal elements 10*a* and 10*b*, respectively, of the frame 10.

As is seen in FIG. 1, the two parts of the clamp 13 exhibit, in the axis of the screw, flats which permit this unit to be put in place between the two longitudinal sides 10*a* and 10*b* of the frame.

The arrangement described permits exerting a considerable pull on the cable, which ensures that the frame elements A, B, C, D are squeezed tight against one another. The glue which covers the contact surfaces undergoes pressure such that it is forced inside the pores of the wood, which considerably improves the rigidity of the fixation.

Figure 4:
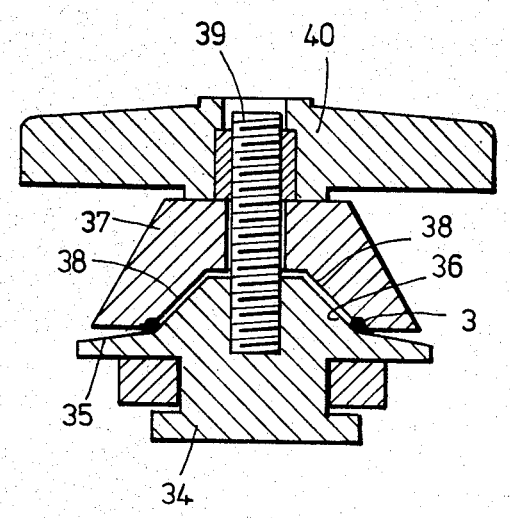

As FIG. 4 shows in a variant of execution, the clamp may be made up of a prism-shaped clamp body 34. More precisely, the part 34 exhibits on each of its longitudinal sides a slightly inclined surface 35 a more sharply inclined surface 36. The gripping part 37, which comes to be fitted on the clamp body 34, exhibits for its part an inside groove limited by two oblique inside faces which extend parallel to the surfaces 36, so that the two end segments of the cable 3 are clamped in the inner dihedral angles of the clamp body 34. The threaded rod 39 and the wing-nut 40 which is screwed on the threaded rod 39 permit tightening the clamp and consequently locking the two ends of the cable. In this embodiment, too, it may be provided for that the longitudinal screw may be disengaged from the clamp, which permits putting the latter in place owing to the flats (not shown) which the part 37 and the body 34 exhibit in the longitudinal direction of the tightener.

The putting to use of the apparatus is extremely easy since the tightener can be grasped with one hand while one operates either the screw 16 in order to clamp the segments of cable in the clamp 13, or the nut 23 in order to tighten the cable. For effecting these maneuvers, the tightener is amply free.

On the other hand, the four angles which rest on the flat support upon which the operation is carried out are rigidly connected to one another through the cable. The clamps 7, 8 are likewise capable of being operated easily since the screws 6 are accessible from the upper end of the angles, while the screws 5 are accessible through the openings 32 described above. The heads of these screws 5 and 6 may be knurled heads or heads provided with hooking means such an external faces or internal faces (Imbus[socket-head hexagon]screws) capable of being operated by means of a wrench or any other tool.

Finally, as has already been said previously, the presence of the openings 32 and of the corresponding cutouts in the plates 7 and 8 permits keeping watch on the state of the joints between the frame elements A, B, C, D, all during the operation.

The apparatus described permits carrying out very delicate and very precise fitting operations. It facilitates the assembling of frames composed of sectional fillets even in the case where, because of their cross-section, these fillets are delicate to manipulate. In particular, thanks to the presence of the cramps movable in the direction parallel to the angles, the positioning of the fillets is possible with very great precision. This is what ensures the great reliability of the device described.

I claim:

1. An apparatus for assembling a plurality of side members to form a closed frame or panel in which adjacent side members are connected to one another to form corners, said frame or panel having the same number of corners as side members, said apparatus comprising:

a plurality of angles, each angle embracing one of said corners, a guide means being provided in each of said angles;

a cable having a central section, first and second ends, and two transitional sections connecting each of said ends to said central section, said central section of said cable passing within said guide means of each of said angles;

a tightener having an elongated rectangular frame provided at one of its ends with two convergent force equilizing slideways, a movable clamp for firmly grasping said ends of said cable mounted on a slide, said slide being longitudinally slidably mounted on said frame, and an operating screw actuating said slide and clamp such that said cable is tightened about said angles by being drawn through said slideways when said operating screw is actuated relative to the frame in the longitudinal direction, said frame being constructed with at least two sides and said clamp being made up of a clamp body provided with guide means and mounted on said slide so that said clamp is able to slide longitudinally between the sides of said frame, and said clamp further having a jaw connected to said clamp body by a tightening screw.

2. Apparatus according to claim 1, characterized in that said angles are each equipped with a cramp acting in a longitudinal direction of a angle.

3. Apparatus according to claim 2, characterized in that the cramps are each controlled by two screws, one of which is situated in an inside corner of the angle and is accessible by means of an elongated lateral opening contrived in an arris of said angle.

4. Apparatus according to claim 1, characterized in that the angles are made up of metal elements of sufficient length to be able to rest with one of their ends on a flat support.

5. Apparatus according to claim 4, characterized in that the angles are provided on their outside, all at the same height relative to their foot, with a thin sheave, said sheave having an arcuate outer edge having a groove serving to guide the cable, each angle being arranged in the outer edge of this sheave.

6. Apparatus according to claim 5, characterized in that the sheaves of the angles are provided with stirrup-pieces distributed along the groove and arranged, so as to hold the cable in said groove.

7. Apparatus according to claim 1, characterized in that the clamp body and the jaw each have two longitudinal grooves, with each one of said end segments of said cable being simultaneously fitted into opposed zones of said grooves, whereby the end segments are protected during clamping.

* * * * *